US005781821A

United States Patent [19]

Nakashima et al.

[11] Patent Number: 5,781,821

[45] Date of Patent: Jul. 14, 1998

[54] DEVELOPING APPARATUS HAVING FLOAT SENSOR SYSTEM FOR REPLENISHING TANK

[75] Inventors: Yoshihiko Nakashima; Togo Kinoshita, both of Wakayama, Japan

[73] Assignee: Noritsu Koki Co., Ltd., Wakayama, Japan

[21] Appl. No.: 736,574

[22] Filed: Oct. 24, 1996

[30] Foreign Application Priority Data

Oct. 26, 1995 [JP] Japan ..... 7-279014
Oct. 21, 1996 [JP] Japan ..... 8-277817

[51] Int. Cl.[6] ..... G03D 3/06

[52] U.S. Cl. ..... 396/626; 396/578; 396/630; 396/632

[58] Field of Search ..... 396/578, 622, 396/626, 630, 632; 399/238

[56] References Cited

U.S. PATENT DOCUMENTS 5,307,109 4/1994 Miyasaka et al. ..... 396/626
5,416,551 5/1995 Ishikawa et al. ..... 396/626
5,611,077 3/1997 Ishikawa et al. ..... 396/630
5,614,979 3/1997 Itoh ..... 396/578

*Primary Examiner*—A. A. Mathews
*Attorney, Agent, or Firm*—Felfe & Lynch

[57] ABSTRACT

A float sensor system for a replenishing tank 70 including an injection nozzle 80 attachable to a liquid feeding nozzle 60 of a replenishing device 70 for replenishing processing liquid to a development processing tank unit. This system includes a float 82 provided to the injection nozzle 80 of a replenishing tank 71–74 and movable between a first position and a second position, and a float detecting sensor 64 mounted to the liquid feeding nozzle 60. When an amount of liquid in the replenishing tank attached to the liquid feeding nozzle 60 exceeds a predetermined value, the float 82 is moved to the first position. When the liquid amount is lower than the predetermined level, the float 82 is moved to the second position. Also, the float detecting sensor 64 outputs a float detection signal when the float 82 is located at this second position.

13 Claims, 7 Drawing Sheets

DEVELOPING APPARATUS HAVING FLOAT SENSOR SYSTEM FOR REPLENISHING TANK

BACKGROUND OF THE INVENTION

1. Field of the Invention

The present invention relates to a float sensor system including a replenishing tank having an injection nozzle attachable to a liquid feeding nozzle of a replenishing device for replenishing processing liquid to a development processing tank unit, and relates also to the replenishing device using this float sensor system. The float sensor system and the replenishing device are mounted to a developing apparatus.

2. Description of the Related Art

A developing apparatus for developing photosensitive material such as a photographic film or a print paper includes a development processing tank unit which forms a plurality of separate chambers therein. These chambers respectively hold therein various kinds of processing liquid such as developing liquid, bleaching liquid, fixing liquid, stabilizing liquid and so on. Further, each chamber of the tank unit is connected with a replenishing device for replenishing fresh un-used processing liquid for compensating for quality deterioration of the processing liquid. This replenishing device includes, for instance, a replenishing tank, a replenishing passage and a pump. In operation, when necessary, the processing liquid held within the replenishing tank is supplied to the development processing tank unit by using the pump. In the course of this, the remaining amount of the replenishing liquid held in the replenishing tank is checked by means of a liquid level sensor such as a float sensor disposed within the replenishing tank. When the remaining amount becomes small, processing liquid must be refilled to the replenishing tank. For facilitating such refilling operation, it has been proposed to provide the replenishing tank filled with processing liquid per se as a commercially available replacement item.

However, with the above replacement item type replenishing tank, the manufacturer needs to provide each tank with the liquid surface level sensor for checking the remaining liquid amount and also the user needs to connect the sensor with the developing apparatus. Hence, this method suffers the problems of costs of the replenishing tank and the troublesomeness of its replacement operation.

Alternatively, it is also conceivable to provide the liquid surface level sensor as a 'throw-in' type unit which is permanently connected with the developing apparatus proper. In this case too, however, it is necessary to provide the replenishing tank with an entrance opening for receiving the level sensor or with some arrangement for avoiding interference with the wire connecting operation of the level sensor. However, these conventional methods have not been able to solve the problems satisfactorily.

SUMMARY OF THE INVENTION

In a float sensor system for checking a remaining amount of processing liquid within a development processing liquid replenishing tank of replaceable type, a primary object of the present invention is to provide an improved float sensor system capable of minimizing cost increase of the tank as well as the trouble of its replacement operation.

A further object of the invention is to provide a replenishing device using the above-described float sensor system.

A still further object of the invention is to mount the float sensor system and the replenishing device in a developing apparatus.

For accomplishing the above-noted primary object, a float sensor system, according to the present invention, comprises: a float mounted to an injection nozzle of a replenishing tank and movable between a first position and a second position; and a float detecting sensor attached to a liquid feeding nozzle; wherein the float is moved to the first position when an amount of liquid held within the replenishing tank mounted to the liquid feeding nozzle exceeds a predetermined value, whereas, when the liquid amount is smaller than the predetermined value, the float is moved to the second position and also the float detecting sensor outputs a float detection signal.

With the above-described construction, the replenishing tank needs to include only the float as the target of detection to be detected by the float detecting sensor. Hence, the construction of the replenishing tank may be simple and cost increase of the tank may be restricted. On the other hand, the replenishing device is provided with the float detecting sensor for detecting the float. Yet, as this sensor is assembled in advance with the replenishing device when this device is manufactured, no wire connecting operation is needed for the user at the time of tank replacement. Accordingly, it becomes possible to prevent its wire connecting operation from making the tank replacement troublesome.

The development processing tank needs to store various processing liquids such as developing liquid, bleaching liquid, fixing liquid, stabilizing liquid or the like in mutually separated state. For this reason, the processing tank is constructed as a development processing unit forming a plurality of separate chambers for holding the various liquids separately from each other. Then, in order to facilitate the replacement operation of the replenishing tanks, it has been proposed to use a single replenishing package integrating the respective replenishing tanks to be mounted to respective liquid feeding nozzles communicated with these chambers. In such construction too, the float sensor system, according to the spirit of the invention, may be realized by the above-described float mounted to an injection nozzle of each replenishing tank and movable between a first position and a second position; and the above-described float detecting sensor attached to each liquid feeding nozzle.

With the above construction, only by one step operation of attaching the respective injection nozzles of the replenishing package into registry with the corresponding liquid feeding nozzles of the replenishing device proper, assembly of the float sensor for allowing checking of amount of each processing liquid may be completed.

For accomplishing the above-noted further object, in a replenishing device for replenishing various kinds of processing liquid to a development processing tank unit from a replenishing package which includes a plurality of replenishing chambers holding the various processing liquids separately from each other, a plurality of injection nozzles provided for the respective chambers, and a plurality of floats provided for the respective injection nozzles, each float being movable to a detectable position when an amount of liquid in the corresponding replenishing chamber exceeds a predetermined value, the replenishing device includes a plurality of liquid feeding nozzles connectable with the respective injection nozzles, and a plurality of replenishing passages for connecting the liquid feeding nozzles to the corresponding development processing tank, the device comprises:

a closing ring slidable along a peripheral surface of the liquid feeding nozzle along a direction of axis of the nozzle between a first position for closing a liquid feeding hole defined in the peripheral surface of the liquid feeding nozzle and a second position for opening the liquid feeding hole; and a float detecting sensor disposed adjacent the liquid feeding hole of the liquid feeding nozzle and capable of detecting the float at the detectable position;

wherein, the closing ring is urged to the first position by a spring, and the closing ring is moved by the replenishing package to the second position against the urging force of the spring when the replenishing package is attached to the replenishing device.

With the above-described construction, this replenishing device, namely, the user of the development processing device may enjoy the benefit of automatic liquid level check simply by purchasing and using any replenishing package regardless of its shape or capacity as long as this package satisfies the above-described requirements.

According to one aspect of the present invention, the injection nozzle is disposed into inner space of the replenishing tank and the float is movable along an outer peripheral surface of the injection nozzle, so that the float may be disposed within the inner space of the replenishing tank so as to avoid a trouble due to accidental contact of the float. Further, it is also conceivable to provide the float with a magnet and to construct the float detecting sensor as a magnetism responsive sensor comprised of a lead switch, a hole element or the like which responds to the magnet and outputs the float detection signal. Since such magnetism responsive sensor is a noncontact type sensor, this sensor and its connecting cable may be embedded within resin material or the like, whereby the sensor may be effectively protected against corrosion by the processing liquid or accidental contact. Further, for improving the precision in the detection of the float position, the float may be provided with a non-light transmitting property, with constructing the float detecting sensor as an optical sensor.

According to a still further aspect of the invention, when any one of the floats of the respective chambers of the replenishing package is detected by the float detecting sensor, a replacement request signal for requesting replacement of the entire replenishing package is issued. Namely, it is possible to approximately estimate in advance the consumption amounts of the respective processing liquids. Then, if at least one kind of processing liquid has been exhausted, it may be assumed that the other kinds of processing liquid too have been nearly exhausted. Therefore, the above method is suitable for the replenishing operation using the replenishing package.

According to the present invention, the float sensor system and the replenishing device having the above-described features are to be incorporated within a development processing apparatus. Hence, the art of utilizing replenishing package may significantly contribute to compactness of the development processing system.

Further and other objects, features and effects of the invention will become more apparent from the following more detailed description of the embodiments of the invention with reference to the accompanying drawings.

DESCRIPTION OF THE PREFERRED EMBODIMENTS

Next, preferred embodiments of the present invention relating to an automatic film developing apparatus 1 as a developing apparatus will be described with reference to the accompanying drawings.

Figure 1:
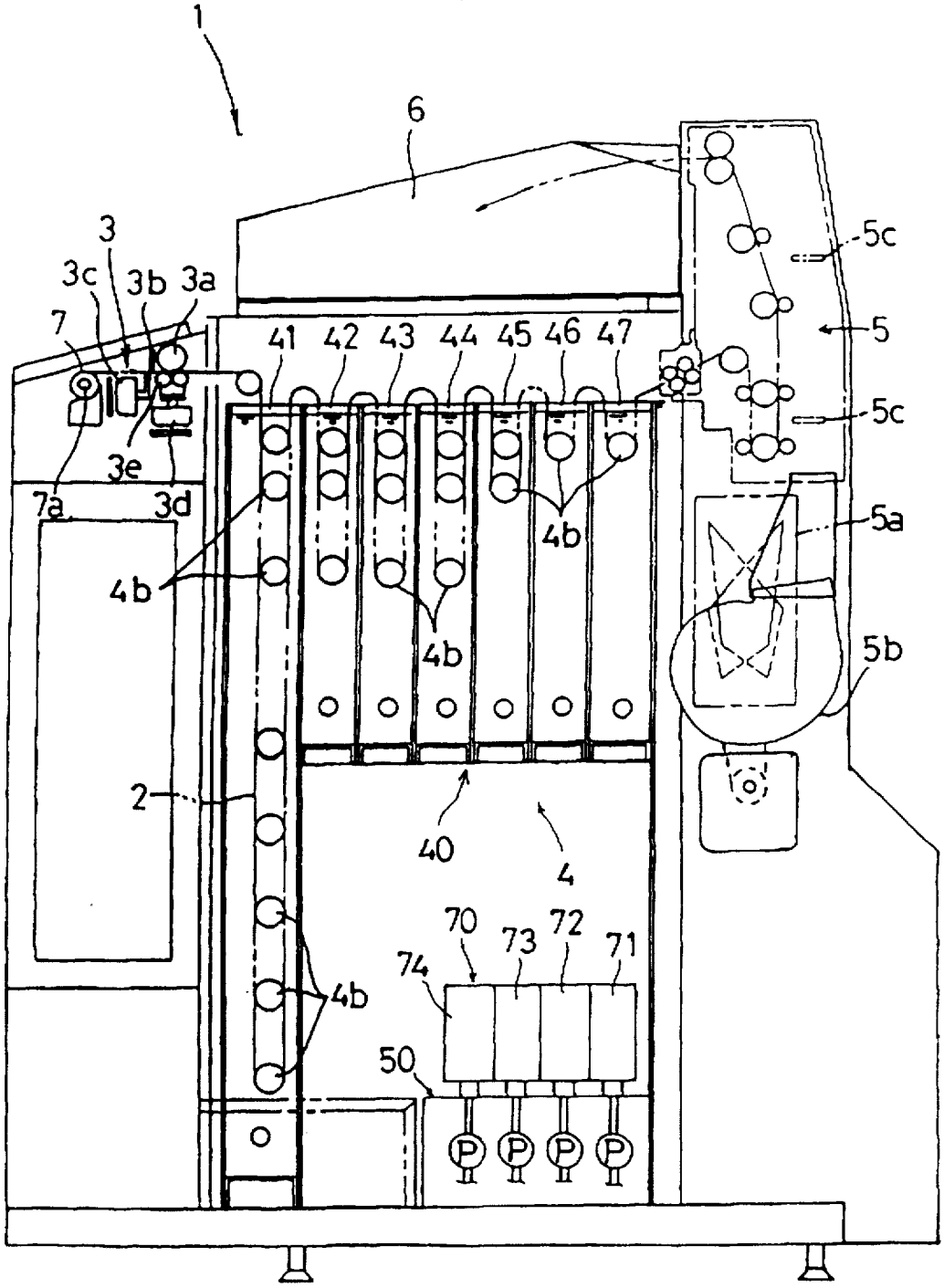
FIG. 1 is an overall construction view of an automatic film developing apparatus using a float sensor system according to one preferred embodiment of the present invention.

As shown in FIG. 1, the automatic film developing apparatus 1 includes a film loading section 3 for loading a film 3 (an example of photosensitive material) with a leader connected to a leading end thereof, a film developing section 4 for developing the film 2 fed from the film loading section 3, a film drying section 5 for drying the developed film 2, and a film receiver section 6 for temporarily holding the film 2 after its drying operation.

The film loading section 3 includes a transport roller 3*a*, a film cutter 3*b* for cutting off a trailing end of the film 2 which has been entirely withdrawn from a film patrone 7, a film cutting solenoid 3*c* for slidably driving one of paired cutter blades of the film cutter 3*b*, a free roller 3*e* operable, under a pressing state thereof, to press the film 2 against the transport roller 3*a*, and a pressing solenoid 3*d* for switching over the free roller 3*e* between the pressing state and a non-pressing state by vertically moving this roller 3*e*. The film 2 entirely withdrawn from and cut off the patrone 7 is transported as being pinched between the transport roller 3*a* and the free roller 3*e* to be introduced into the film developing section 4.

The film developing section 4 includes a processing tank 40 having total 7 (seven) separate chambers for individually holding therein a plurality of kinds of processing liquid such as developing liquid, bleaching liquid, fixing liquid, stabilizing liquid and so on for effecting a series of processing steps such as development, bleaching, fixation and so on. The developing section 4 also includes a plurality of transport roller units 4*b* for transporting the film 2 within this developing section 4.

As shown in FIG. 1, the film drying section 5 disposed at a downstream position in a film transport passage relative to the film developing section 4 includes a drying heater 5*a* for drying the film 2, a drying fan 5*b* for supplying hot air to the film transport passage and a temperature sensor 5*c* for detecting the temperature inside the film drying section 5. So that, through this film drying section 5, the film 2 is transported while being dried gradually. Then, this dried film 2 is discharged to the film receiver section 6.

Figure 3:
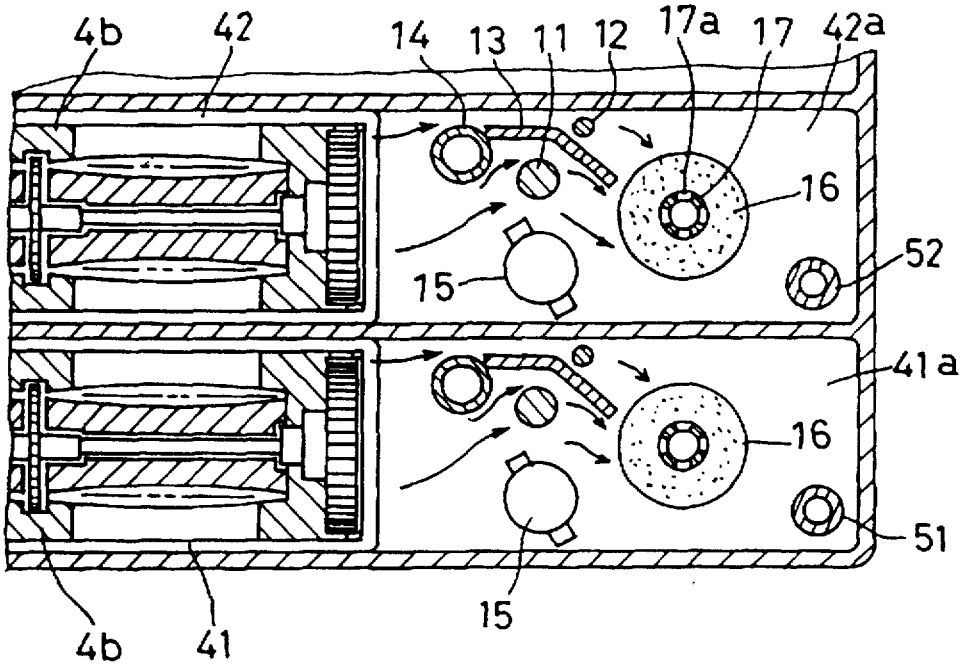
FIG. 3 is a section view taken along a line III—III in FIG. 2.
Figure 4:
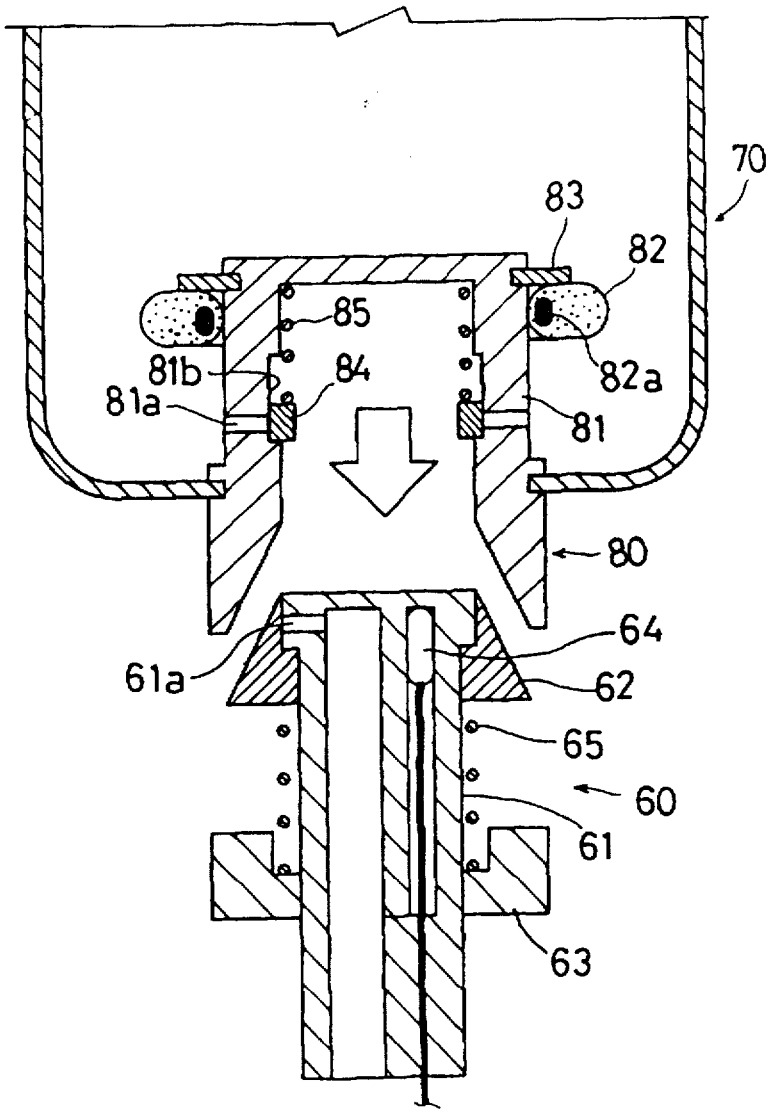
FIG. 4 is a section view of the float sensor system according to the embodiment of the invention.

As described hereinbefore, the processing tank 40 includes the seven processing chambers 41 through 47. Specifically, seen from the entrance direction of the film 2, first is provided the developing liquid chamber 41 having the greatest depth of all the chambers, and then are provided one bleaching liquid chamber 42 and two fixing liquid chambers 43, 44 which are shallower than the developing chamber 41. Thereafter, three stabilizing liquid chambers 45–47 are provided which are the shallowest of all. Except differing in the depths, these chambers 41–47 are constructed otherwise identical. FIG. 3 shows a vertical section of the developing liquid chamber 41 and FIG. 4 shows a horizontal section of the same chamber 41 and of the bleaching liquid chamber 42, respectively.

Figure 2:
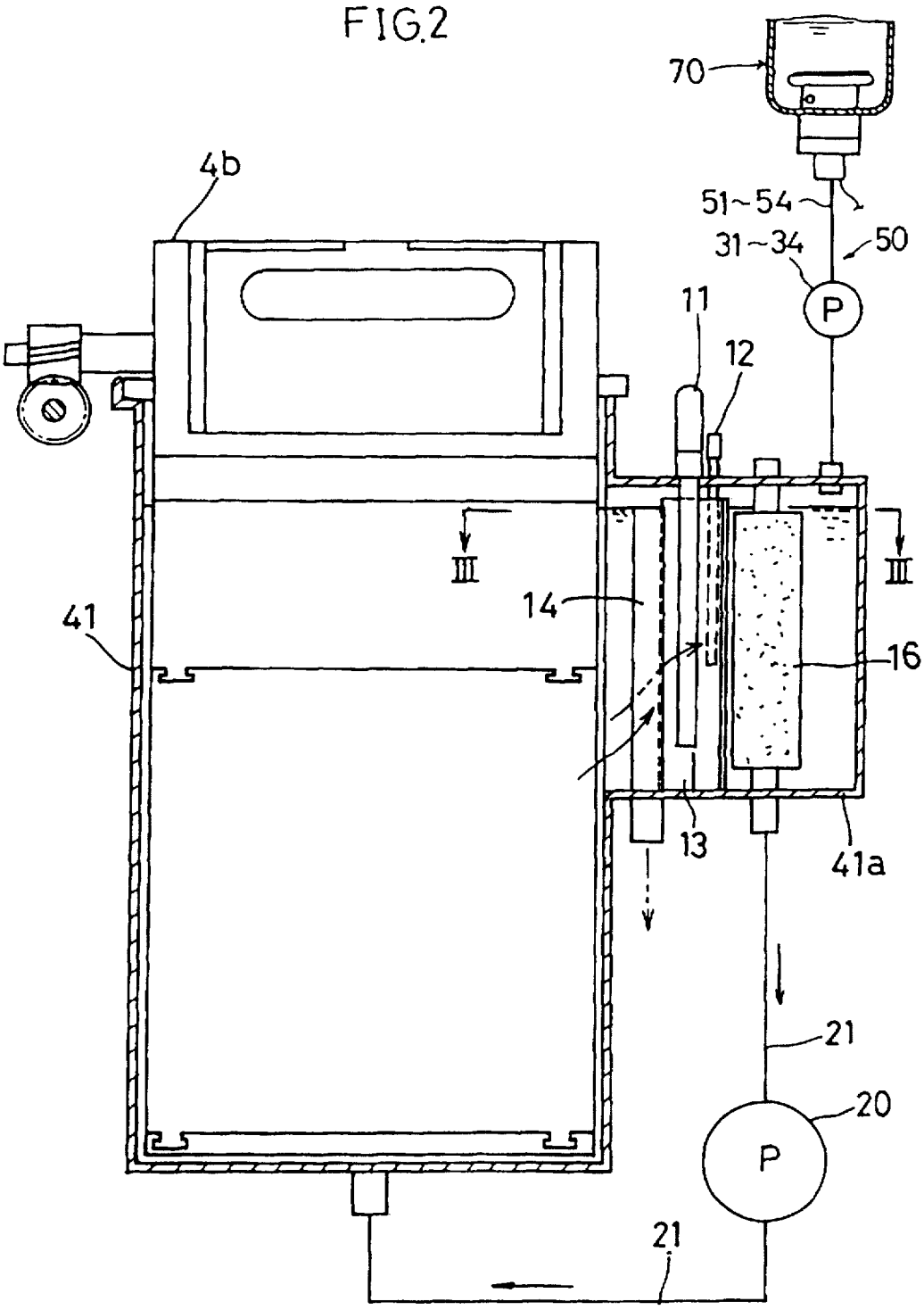
FIG. 2 is a section view of a development processing tank.

As shown in FIG. 2, the developing chamber 41 includes, beside an upper region thereof, an auxiliary tank 41*a*, with the upper region of the chamber 41 and the auxiliary tank 41*a* being communicated with each other. The auxiliary tank 41*a* is communicated also with a bottom of the chamber 41 via a circulating passage 21 which incorporates therein a circulating pump 20. Inside the auxiliary tank 41*a*, there are provided a heater 11 for heating the developing liquid, a temperature sensor 12 for detecting temperature of the developing liquid, a partition plate 13 interposed between the heater 11 and the temperature sensor 12, an overflow pipe 14, a liquid level sensor 15 for detecting the level of the developing liquid, and a filter 16. The heater 11 is controlled so as to maintain the temperature of the developing liquid constant by a feed-back control scheme using the temperature sensor 12. FIG. 2 schematically shows a replenishing device 50. Referring briefly to this replenishing device 50, though greater details will be given later, the auxiliary tank 41*a* is connected with a replenishing pipe 51. Then, in order to maintain constant the activity of the developing liquid, a replenishing pump 31 is operated when necessary to replenish additional fresh developing liquid via the pipe 51 from a developing liquid tank 71 of a replenishing package 70.

The filter 16 is a cylindrical filter having a central bore into which a pipe 17 defining a number slits 17*a* is inserted. In operation, filtered liquid flows through these slits 17*a* into the pipe 17. Further, a lower end of this pipe 17 is communicated with the circulating passage 21. As a result, there is formed a looped circulation line from the upper region of the developing liquid chamber 41, the auxiliary tank 41*a*, the filter 16, the circulating passage 21 incorporating the circulating pump 20, the bottom region of the developing liquid chamber 41 and then back to the upper region of the same, whereby the developing liquid is circulated inside this developing liquid chamber 41. These constructions relating to the auxiliary tank and circulation line are identical for the other chambers also. Hence, the constructions of other chambers will not be described repeatedly. However, in the instant embodiment, a liquid level sensor 51 and a replenishing pipe 51–54 are provided only for the auxiliary tank 41*a* of the developing liquid chamber 41, the auxiliary tank 42*a* of the bleaching liquid chamber 42, and the auxiliary tank 44*a*, 47*a* respectively of the fixing liquid chamber 44 and the stabilizing liquid chamber 47 which are disposed downstream in the direction of film transport. Then, circulation of the stabilizing liquid from the auxiliary tank 44*a* of the fixing liquid chamber 44 to the auxiliary tank 43*a* of the other fixing liquid chamber 43 and circulation of the stabilizing liquid from the auxiliary tank 47*a* of the stabilizing liquid chamber 47 to the auxiliary tank 46*a* and then from this tank 46*a* to the further auxiliary tank 45*a* are effected via un-illustrated cascade pipes.

The replenishing package 70 is an integral assembly integrating the developing liquid replenishing tank 71, the bleaching liquid replenishing tank 72, the fixing liquid replenishing tank 73 and the stabilizing liquid replenishing tank 74. Each replenishing tank 71–74 is equipped with an injection nozzle 80 for discharging the liquid from the tank. On the other hand, the replenishing device 50 includes four liquid feeding nozzles 60 connectable with the respective injection nozzles 80. Then, by mounting the replenishing package 70 to the replenishing device 50 with connecting the injection nozzles 80 of the former to the respective corresponding liquid feeding nozzles 60 of the latter, communications are established between the replenishing tanks 71–74 and the replenishing passages 51–54, respectively.

FIG. 4 shows the injection nozzle 80 of the replenishing package 70 and the liquid feeding nozzle 60 of the replenishing device 50. The injection nozzle 80 includes a cup-shaped nozzle proper 81, a ring-shaped float 82 slidably fitted about an outer peripheral wall of the nozzle proper 81, and a retainer ring 83 attached to the bottom of the nozzle proper 81 for retaining the float 82 against inadvertent withdrawal thereof from the nozzle proper 81. Then, the nozzle proper 81 is inserted to project into the inner space of the replenishing tank. And, the outer peripheral wall of this inserted nozzle proper 81 defines a number of through holes 81*a* for allowing communication between the inside and outside of the replenishing tank. In the inner peripheral side of the float 82, there is embedded a magnet 82*a*. With the replenishing package 70 being attached to the replenishing device 50, the float 82 is placed in contact with the retainer ring 83 when the replenishing liquid remains to a level higher than the bottom of the nozzle proper 81. When the liquid is diminished in the amount to a level lower than the bottom of the nozzle proper 81, the float 82 drops to this low liquid level.

The liquid feeding nozzle 60 of the replenishing device 50 includes a nozzle pipe 61, a closing ring 62 slidable axially along an outer peripheral face of the nozzle pipe 61, a stopper 63 for this closing ring 62, and a lead switch 64 as a float detecting sensor fitted within an elongate hole extending to the vicinity of the head of the nozzle pipe 61. This head of the nozzle pipe 61 is closed, and instead there are provided a number of liquid feeding holes 61 extending through the outer peripheral wall. Further, the head of the nozzle pipe 61 is slightly enlarged in the diameter, so that this head acts also as a retainer for the closing ring 62. The closing ring 62, at an upper end position thereof, closes the liquid feeding holes 61*a*. That is to say, the inner space of the nozzle is opened only when the closing ring 62 is pressed down. A numeral 65 denotes a spring which urges the closing ring 62 toward the upper end position.

When the replenishing package 70 is attached to the replenishing device 50, the injection nozzle 80 presses down the closing ring 62. For this reason, the closing ring 62 has a truncated cylindrical outer peripheral surface and the leading end of the nozzle proper 81 is formed so as to fit this truncated cylindrical outer peripheral surface.

As may be apparent from FIG. 4, a stopper ring 84 is fitted in a ring-shaped recess 81*b* defined in the inner peripheral face of the nozzle proper 81, with the stopper ring 84 being slidable between a position for closing the through holes 81*a* and a further position opening the through holes 81*a*. Further, this stopper ring 84 is urged by a spring 85 to the former position for closing the through holes 81*a*, and the ring 84 is forcibly moved to the latter position for opening the through holes 81*a* with insertion of the nozzle pipe 61 into the nozzle proper 81. With this, it becomes possible to prevent the replenishing liquid from being leaked through the through holes 81*a* before the insertion of the liquid feeding nozzle 60 into the injection nozzle 80.

Figure 5A:
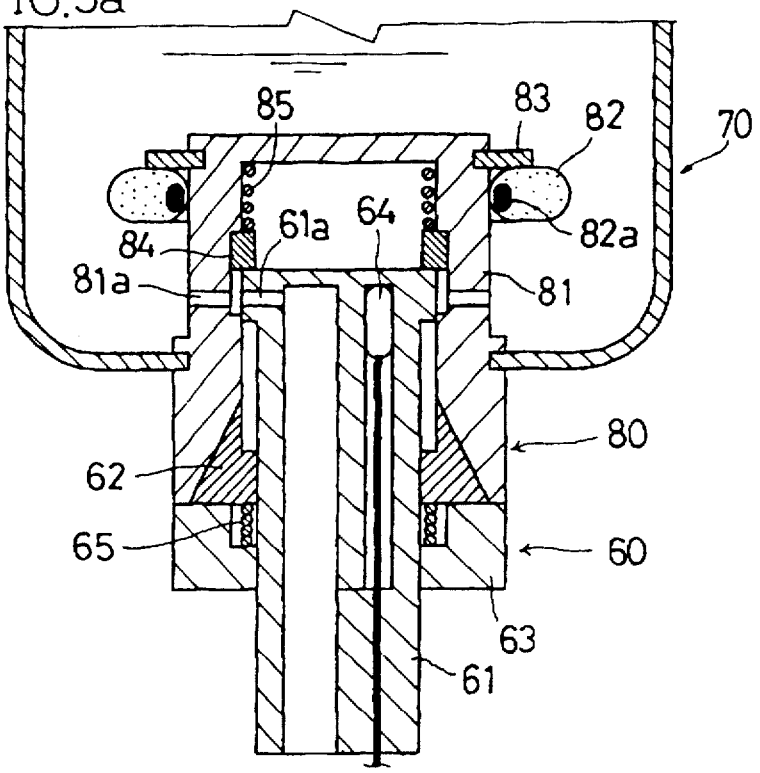
FIG. 5*a* is an operation descriptive view showing the float sensor system of FIG. 4 under a condition where no processing liquid is present therein.
Figure 5B:
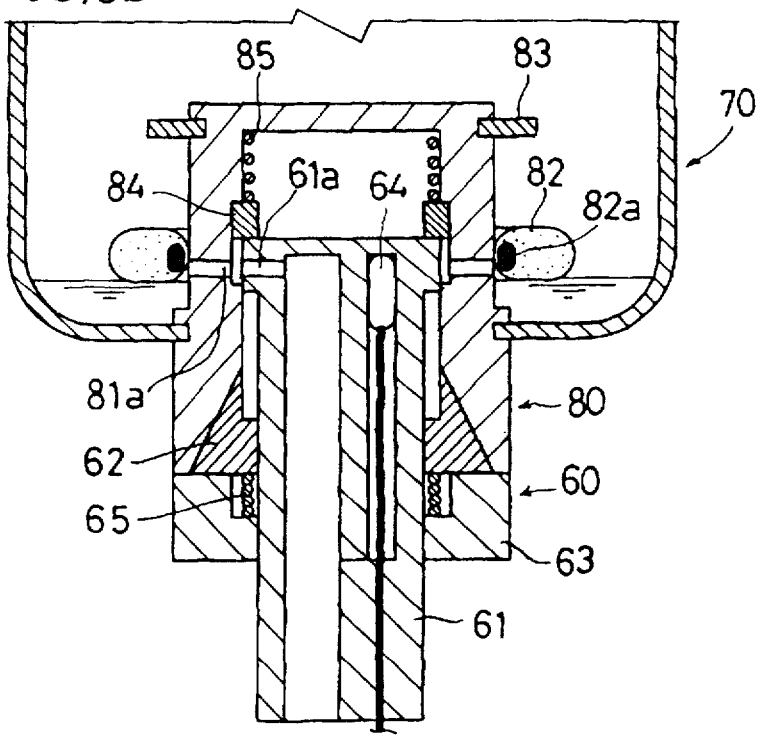
FIG. 5*b* is an operation descriptive view showing the float sensor system of FIG. 4 under a further condition where processing liquid is present therein.

FIGS. 5*a* and 5*b* illustrate change in the liquid surface level within each replenishing tank of the replenishing package 70 attached to the replenishing device 50 and associated movement of the float 82. Specifically, FIG. 5*a* shows a condition where a sufficient amount of replenishing liquid remains within the replenishing tank, i.e. when the liquid surface level is above the bottom of the nozzle proper 81. In this condition, as shown, the float 82 is located in abutment against the retainer ring 83 by effect of the floating force. FIG. 5*b* shows a further condition where the replenishing liquid in the tank has diminished, i.e. the liquid surface level has dropped below the bottom of the nozzle proper 81. In this condition, as shown, the float 82 has moved down to the vicinity of the lead switch 64. With this, the lead switch 64 responds to the magnet 82*a* of the float 82, whereby exhaustion of the liquid in the tank may be detected.

Figure 6:
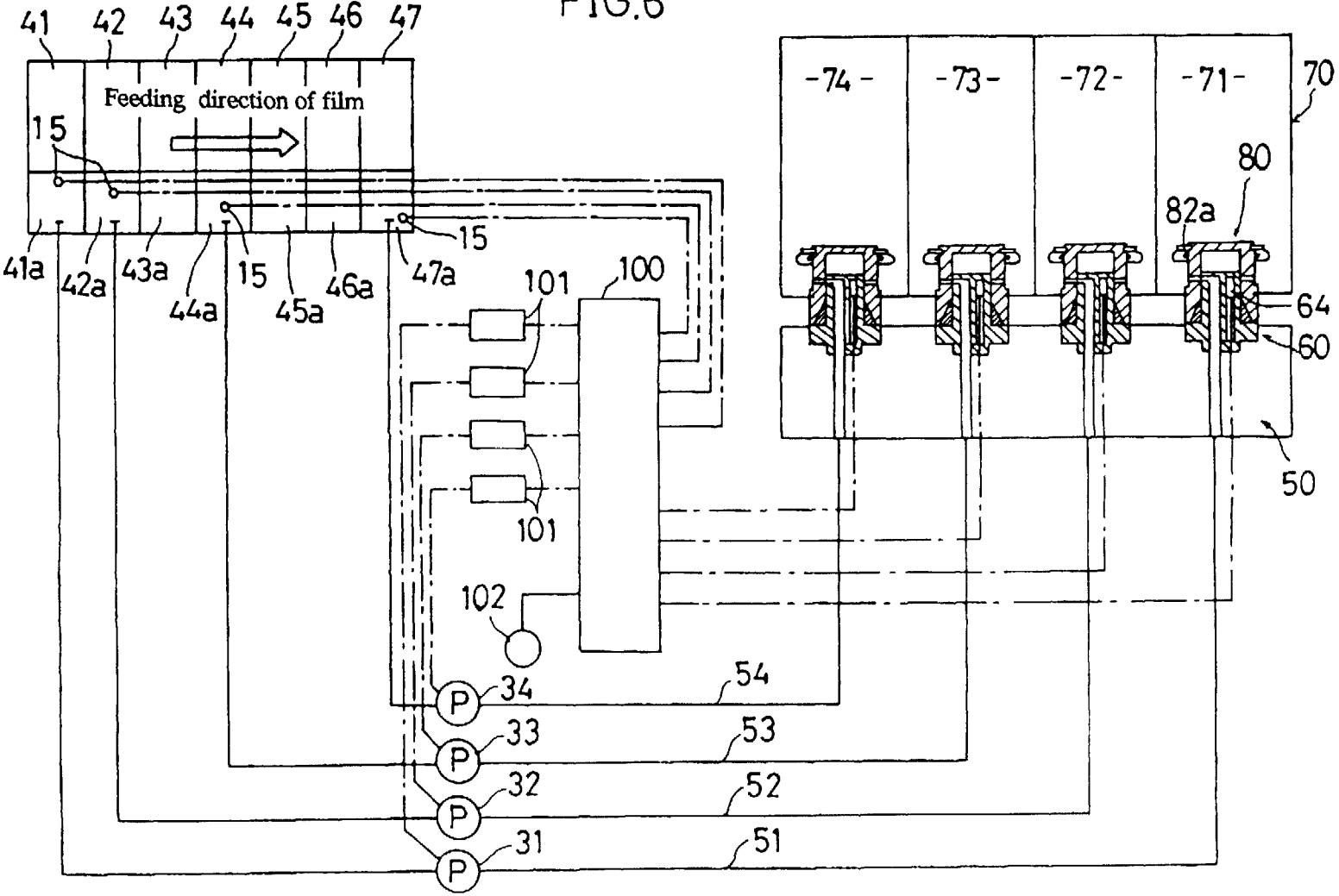
FIG. 6 is a control block diagram.

Next, the liquid exhaustion detection control using the float sensor system described above will be described in details with reference to a block diagram of FIG. 6.

The liquid level sensors 15 provided for the auxiliary tank 41*a* of the developing liquid chamber 41, the auxiliary tank 42*a* of the bleaching liquid chamber 42, the auxiliary tank 44*a* of the fixing liquid chamber 44 and the auxiliary tank 47*a* of the stabilizing liquid chamber 47 are all connected to a digital control device 100 comprised mainly of a microcomputer. Based on a signal transmitted from each liquid surface level sensor 15, the control device 100 can recognize which of the developing liquid, bleaching liquid, fixing liquid and stabilizing liquid chambers is running short of the liquid. Further, those auxiliary tanks 41*a*, 42*a*, 44*a*, 47*a* having the liquid level sensors 15 include discharge openings of the respective replenishing passages 51–54. The other ends of these replenishing passages 51–54 are connected with the liquid feeding nozzles 60 for the respective replenishing liquids of the replenishing device 50 and these passages 51–54 also incorporate therein replenishing pumps 31–34. The operations of these pumps 31–34 are controlled via respective pump drivers 101 by the control device 100. For instance, in order to maintain constant the activity of the processing liquid, the replenishing pump 31 is driven in accordance with the type and/or length of the film, so as to replenish fresh processing liquid from the replenishing tank 71 to the corresponding auxiliary tank 41*a*. Incidentally, in addition to the control of these replenishing pumps 31–34, the control device 100 is responsible also for control of the entire automatic film developing apparatus.

Further, the control device 100 is connected also with each lead switch disposed within the liquid feeding nozzle 60 of the replenishing device 50 so as to respond to the magnet 82*a* when the float 82 attached to the injection nozzle 80 of the replenishing package 70 has moved downwards. Accordingly, when the liquid of any one of the replenishing tanks 71–74 has been exhausted and the corresponding lead switch 64 transmits a float detection signal to the control device 100, the control device 100 activates an alarm device 102 such as a buzzer, a lamp or the like, thereby to notify the user of necessity of replacement of the replenishing package 70.

Figure 7A:
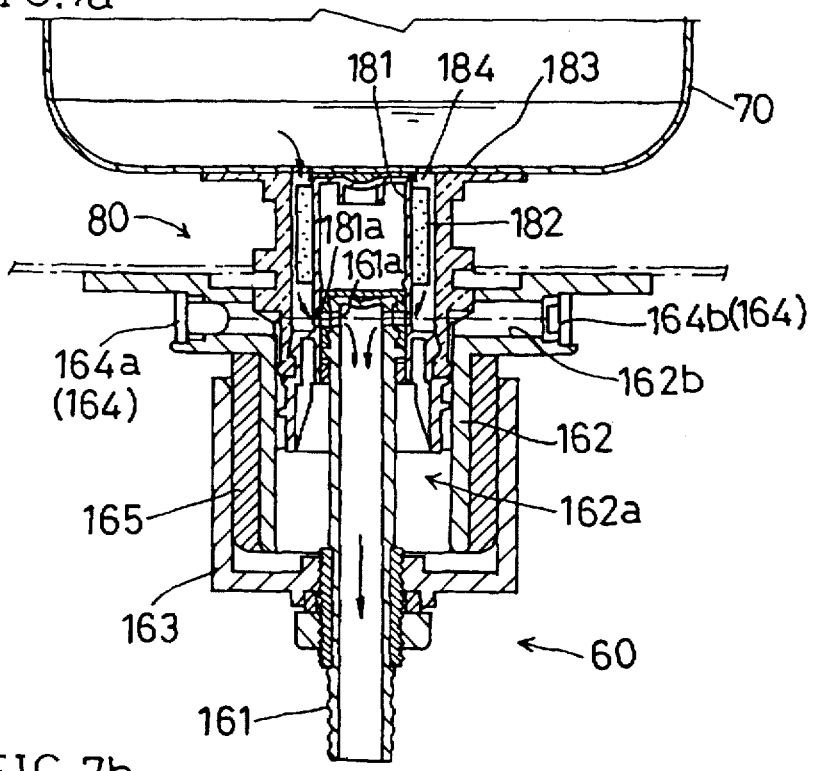
FIG. 7*a* is an operation descriptive view showing a float sensor system according to a further embodiment under a condition where no processing liquid is present therein.
Figure 7B:
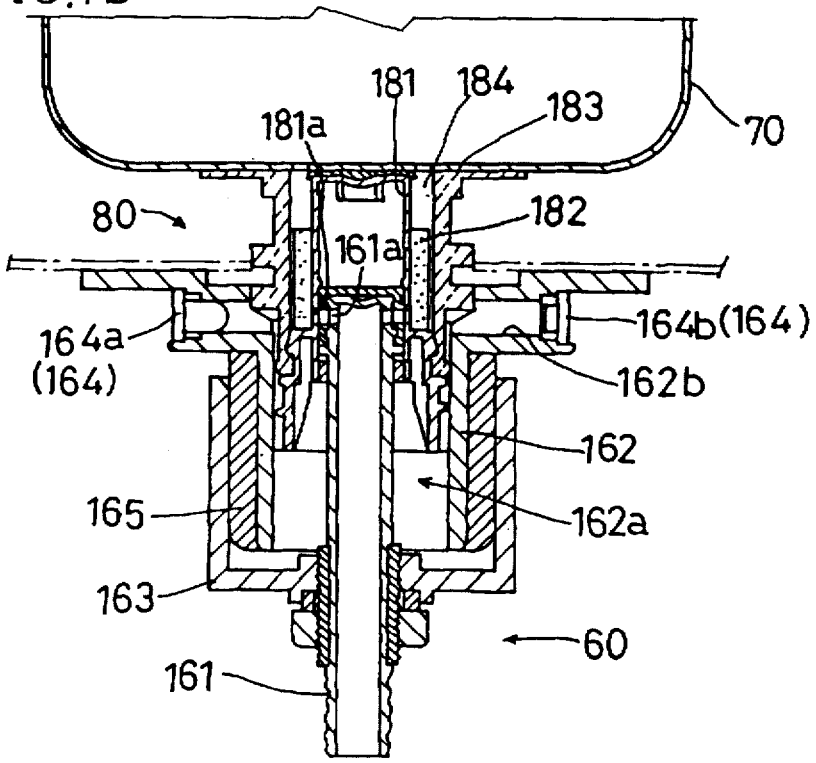
FIG. 7*b* is an operation descriptive view showing the float sensor system according to the further embodiment under a condition where processing liquid is present therein.

FIGS. 7*a* and 7*b* show a further embodiment of the injection nozzle 80 of the replenishing package 70 and the liquid feeding nozzle 60 of the replenishing device 50. As may be understood from FIG. 7*a*, the injection nozzle 80 according to this embodiment is mounted outside the tank and includes an inner cylinder member 181, an outer cylinder member 183 disposed coaxially relative to the inner cylinder member 181 with forming an annular space 184 therebetween, and a ring-shaped float 182 fitted within the annular space 184.

On the other hand, the liquid feeding nozzle 60 according to this embodiment includes a cylindrical seat member 162 defining a cylindrical opening 162*a* for receiving the above-described injection nozzle 80, a nozzle pipe 16-1 connected to the replenishing passage 51–54 and having a sealing element at a leading end thereof, and a bearing sleeve 163 for bearing the seat member 162 via a spacer 165. As the leading end of the nozzle pipe 161 is inserted into the inner cylinder member 181, communication is established between the replenishing package 70 and the replenishing device 50. With this establishment of communication, the replenishing liquid held in the tank flows through the opening of the tank first into the annular space 184 and then flows past through holes 181*a* defined in the tank and a through hole 161*a* defined at the leading end of the nozzle pipe 161 and then flows into this nozzle pipe 161. The replenishing liquid introduced into the nozzle pipe 161 is then caused to flow through the replenishing passage 51–54 by the function of the replenishing pump 31–34. Further, adjacent the opened end of the opening 162*a* of the seat member 162, there are provided a pair of opposed and radially extending through holes 162*b*, at which a beam emitter 164*a* and a beam receiver 164*b* together constituting a float detecting sensor 164 are attached.

FIG. 7*a* shows a condition in which a sufficient amount of replenishing liquid remains within the replenishing tank. In this condition, the liquid surface level is above the leading end of the nozzle pipe 161 so as not to block transmission of beam of the optical sensor 164. Conversely, FIG. 7*b* shows a further condition where the replenishing liquid in the tank has been exhausted, in which case the liquid surface level is below the leading end of the nozzle pipe 161 so as to allow the float 182 to be dropped by the gravity down onto the bottom of the annular space 184, thereby to block the transmission of the beam of the optical sensor 164. That is to say, in the case of this embodiment, the float 182 is made of non-light transmitting material or provided with some arrangement for blocking the light transmission such as surface coating with non-light transmitting material. Accordingly, the floating and sinking movements of the float 182 for detecting replenishing liquid exhaustion may be detected by means of light beam. For the same purpose, any portions of the injection nozzle 80 and of the liquid feeding nozzle 60 located in the midway of the beam transmission path of the optical sensor 164 are made at least partially of some light transmitting material or provided with some light transmitting arrangement such as formation of through hole (s). Needless to say, this optical sensor 164 is operatively connected with the control device 100.

In this case too, like the injection nozzle described hereinbefore with reference to FIG. 4, though not shown, a stopper is provided for opening/closing the through holes 181*a* of the inner cylinder member 181, so as to prevent leakage of the replenishing liquid through the through holes 181*a* prior to the insertion of the liquid feeding nozzle 60 into the injection nozzle 80.

In the foregoing embodiments, the capacities of the respective replenishing tanks 71–74 of the replenishing package 70 are designed in advance so that the liquids of all the tanks will be exhausted substantially simultaneously. Therefore, when one replenishing tank is exhausted of its liquid, the entire replenishing package 70 will be replaced by a new one. This makes it possible to avoid the trouble of individually maintaining the plural tanks. Needless to say, however, the float sensor system of the invention may be embodied with a replenishing device including separate replenishing tanks which are to be maintained separately.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A float sensor system for a replenishing tank having an injection nozzle attachable to a liquid feeding nozzle of a replenishing device for replenishing processing liquid to a development processing tank unit, the system comprising:

a float mounted to the injection nozzle of the replenishing tank and movable between a first position and a second position; and a float detecting sensor attached to the liquid feeding nozzle;

wherein the float is moved to the first position when an amount of liquid held within the replenishing tank mounted to the liquid feeding nozzle exceeds a predetermined value, whereas, when the liquid amount is smaller than the predetermined value, the float is moved to the second position and also the float detecting sensor outputs a float detection signal.

2. A float sensor system according to claim 1, wherein the injection nozzle is disposed into inner space of the replenishing tank and the float is movable along an outer peripheral surface of the injection nozzle.

3. A float sensor system according to claim 2, wherein the float includes a magnet and the float detecting sensor is a magnetism responsive sensor which responds to the magnet and outputs the float detection signal.

4. A float sensor system according to claim 1, wherein the float has a non-light transmitting property and the float detecting sensor is an optical sensor.

5. A float sensor system for a replenishing package integrating a plurality of replenishing tanks having injection nozzles respectively attachable to liquid feeding nozzles of a replenishing device for individually replenishing developing liquid, bleaching liquid, fixing liquid and stabilizing liquid to a development processing tank unit, the float sensor system comprising:

a float attached to the injection nozzle of said each replenishing tank;

a float detecting sensor attached to said each liquid feeding nozzle;

wherein the float is moved to the first position when an amount of liquid held within the replenishing tank mounted to the liquid feeding nozzle exceeds a predetermined value, whereas, when the liquid amount is smaller than the predetermined value, the float is moved to the second position and also the float detecting sensor outputs a float detection signal.

6. A float sensor system according to claim 5, wherein, when any one of the floats of the respective replenishing tanks is detected by the float detecting sensor, a replacement request signal for requesting replacement of the entire replenishing package is issued.

7. A float sensor system according to claim 2, wherein the injection nozzle is disposed into inner space of the replenishing tank and the float is movable along an outer peripheral surface of the injection nozzle.

8. A float sensor system according to claim 7, wherein the float includes a magnet and the float detecting sensor is a magnetism responsive sensor which responds to the magnet and outputs the float detection signal.

9. A float sensor system according to claim 5, wherein the float has a non-light transmitting property and the float detecting sensor is an optical sensor.

10. A replenishing device for replenishing various kinds of processing liquid to a development processing tank from a replenishing package which includes a plurality of chambers holding the various processing liquids separately from each other, a plurality of injection nozzles provided for the respective chambers, and a plurality of floats provided for the respective injection nozzles, each float being movable to a detectable position when an amount of liquid in the corresponding replenishing chamber exceeds a predetermined value, the replenishing device comprises:

a plurality of liquid feeding nozzles connectable with the respective injection nozzles;

a plurality of replenishing passages for connecting the liquid feeding nozzles to the corresponding development processing tank;

a closing ring slidable along a peripheral surface of the liquid feeding nozzle along a direction of axis of the nozzle between a first position for closing a liquid feeding hole defined in the peripheral surface of the liquid feeding nozzle and a second position for opening the liquid feeding hole; and a float detecting sensor disposed adjacent the liquid feeding hole of the liquid feeding nozzle and capable of detecting the float at the detectable position;

wherein, the closing ring is urged to the first position by a spring, and the closing ring is moved by the replenishing package to the second position against the urging force of the spring when the replenishing package is attached to the replenishing device.

11. A developing apparatus comprising:

a development processing tank unit;

a replenishing device for replenishing processing liquid to the development processing tank unit, the replenishing device including a replenishing passage having one end thereof connected with the development processing tank unit and the other end thereof connected with a liquid feeding nozzle;

a replenishing tank having an injection nozzle connectable with the liquid feeding nozzle;

float sensor means for detecting a liquid surface level of the replenishing tank, the sensor means including, a float mounted to the injection nozzle of the replenishing tank and movable between a first position and a second position; and a float detecting sensor attached to the liquid feeding nozzle;

wherein the float is moved to the first position when an amount of liquid held within the replenishing tank mounted to the liquid feeding nozzle exceeds a predetermined value, whereas, when the liquid amount is smaller than the predetermined value, the float is moved to the second position and also the float detecting sensor outputs a float detection signal.

12. A developing apparatus comprising:

a development processing tank unit including a plurality of tanks individually holding therein developing liquid, bleaching liquid, fixing liquid and stabilizing liquid;

a replenishing device for replenishing corresponding processing liquid to each tank of the development processing tank unit, the replenishing device including a plurality of replenishing passages each having one end thereof connected with the tank and the other end thereof connected with a liquid feeding nozzle;

a replenishing package integrating a plurality of replenishing tanks each having an injection nozzle connectable with the liquid feeding nozzle for each processing liquid;

float sensor means for detecting a liquid surface level, the sensor means including;

a float attached to the injection nozzle of each replenishing tank and movable between a first position and a second position, and a float detecting sensor attached to each liquid feeding nozzle;

wherein the float is moved to the first position when an amount of liquid held within the replenishing tank mounted to the liquid feeding nozzle exceeds a predetermined value, whereas, when the liquid amount is smaller than the predetermined value, the float is moved to the second position and also the float detecting sensor outputs a float detection signal.

13. A developing apparatus comprising:

a development processing tank unit including a plurality of tanks individually holding therein developing liquid, bleaching liquid, fixing liquid and stabilizing liquid;

a replenishing package which includes a plurality of replenishing chambers holding the various processing liquids separately from each other, a plurality of injection nozzles provided for the respective chambers, and a plurality of floats provided for the respective injection nozzles, each float being movable to a detectable position when an amount of liquid in the corresponding replenishing chamber exceeds a predetermined value; and a replenishing device for replenishing corresponding processing liquid to each tank of the development processing tank unit from the replenishing package, the replenishing device including, a plurality of liquid feeding nozzles connectable with the respective injection nozzles, a replenishing passages connecting one of the liquid feeding nozzles to the tank corresponding thereto, a closing ring slidable along a peripheral surface of the liquid feeding nozzle along a direction of axis of the nozzle between a first position for closing a liquid feeding hole defined in the peripheral surface of the liquid feeding nozzle and a second position for opening the liquid feeding hole; and a float detecting sensor disposed adjacent the liquid feeding hole of the liquid feeding nozzle and capable of detecting the float at the detectable position;

wherein, the closing ring is urged to the first position by a spring, and the closing ring is moved by the replenishing package to the second position against the urging force of the spring when the replenishing package is attached to the replenishing device.

* * * * *